US007320313B1

(12) United States Patent
Zahdeh

(10) Patent No.: US 7,320,313 B1
(45) Date of Patent: Jan. 22, 2008

(54) DIFFERENTIAL PRESSURE REGULATOR FOR FUEL SYSTEMS

(75) Inventor: Akram R. Zahdeh, Oakland, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/668,652

(22) Filed: Jan. 30, 2007

(51) Int. Cl.
*F02M 69/54* (2006.01)
*F02M 69/52* (2006.01)

(52) U.S. Cl. ..... 123/457; 123/514

(58) Field of Classification Search ..... 123/457, 123/459, 461, 463, 510, 512, 514
See application file for complete search history.

(56) References Cited

U.S. PATENT DOCUMENTS 3,618,383 A * 11/1971 Holden ..... 73/203
4,175,433 A * 11/1979 Rikuta ..... 73/196
4,986,240 A * 1/1991 Muraji et al. ..... 123/452
5,031,596 A * 7/1991 Muraji ..... 123/463
5,785,023 A * 7/1998 Cross ..... 123/463

* cited by examiner

*Primary Examiner*—Mahmoud Gimie

(57) ABSTRACT

A differential pressure regulator includes a housing having a first and second chamber, a fuel pump inlet, a passage, and a return orifice. The fuel pump inlet is in fluid communication with the passage and the first chamber while the return orifice is in fluid communication with the passage and the second chamber. A movable diaphragm separates the first chamber from the second chamber with a first and a second needle valve connected to opposing sides of the diaphragm. The first needle valve is reciprocally disposed in the fuel pump inlet while the second needle valve is reciprocally disposed in the return orifice. The differential pressure regulator also includes a fuel injection supply opening that is located in the first chamber and the return opening that is located in the second chamber.

14 Claims, 2 Drawing Sheets

DIFFERENTIAL PRESSURE REGULATOR FOR FUEL SYSTEMS

FIELD OF THE INVENTION

The present invention relates to vehicle fuel systems, and more particularly to pressure regulation of vehicle fuel systems.

BACKGROUND OF THE INVENTION

In an automotive fuel system, fuel is pumped from a tank through a fuel rail into an injector. The pressure of the fuel delivered to the injector is controlled to allow a desired quantity of fuel to pass through the injectors into the cylinders of the engine. Pressure regulators are incorporated in the fuel rail to provide pressure control. Excess fuel that is pumped from the tank through a fuel rail is returned to the tank through a return line.

Conventional pressure regulators used in fuel systems include either a spring loaded diaphragm or a steel ball with a leaf spring that is balanced against fluid pressure. These devices control absolute pressure in the fuel system and have the tendency to become unstable in designs that require its location directly on or near a fuel pump. This is undesirable because the pressure in the fuel system should remain as constant as possible to minimize internal losses and maximize engine power and fuel consumption. In addition to having the propensity to become unstable, pressure regulators are typically very noisy under these design conditions due to their conventional designs.

SUMMARY OF THE INVENTION

A differential pressure regulator according to the present invention includes a housing having a first and second chamber, a fuel pump inlet, a passage, and a return orifice. The fuel pump inlet is in fluid communication with the passage and the first chamber while the return orifice is in fluid communication with the passage and the second chamber. A movable diaphragm separates the first chamber from the second chamber with a first and a second needle valve connected to opposing sides of the diaphragm. The first needle valve is reciprocally disposed in the fuel pump inlet while the second needle valve is reciprocally disposed in the return orifice. The differential pressure regulator also includes a fuel injection supply opening that is located in the first chamber and a return opening that is located in the second chamber.

In other features, the differential pressure regulator has a check valve located inside the passage that prevents flow from the fuel pump inlet to the return orifice until a threshold pressure has been reached. Delivering fuel to the fuel pump inlet creates high pressure in the first chamber and flexes the diaphragm moving the second needle valve into a position that prevents flow from the fuel pump inlet to the return orifice. When pressure in the first chamber reaches the threshold pressure, the check valve allows flow from the fuel pump inlet to the return orifice until the diaphragm settles in an equilibrium position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
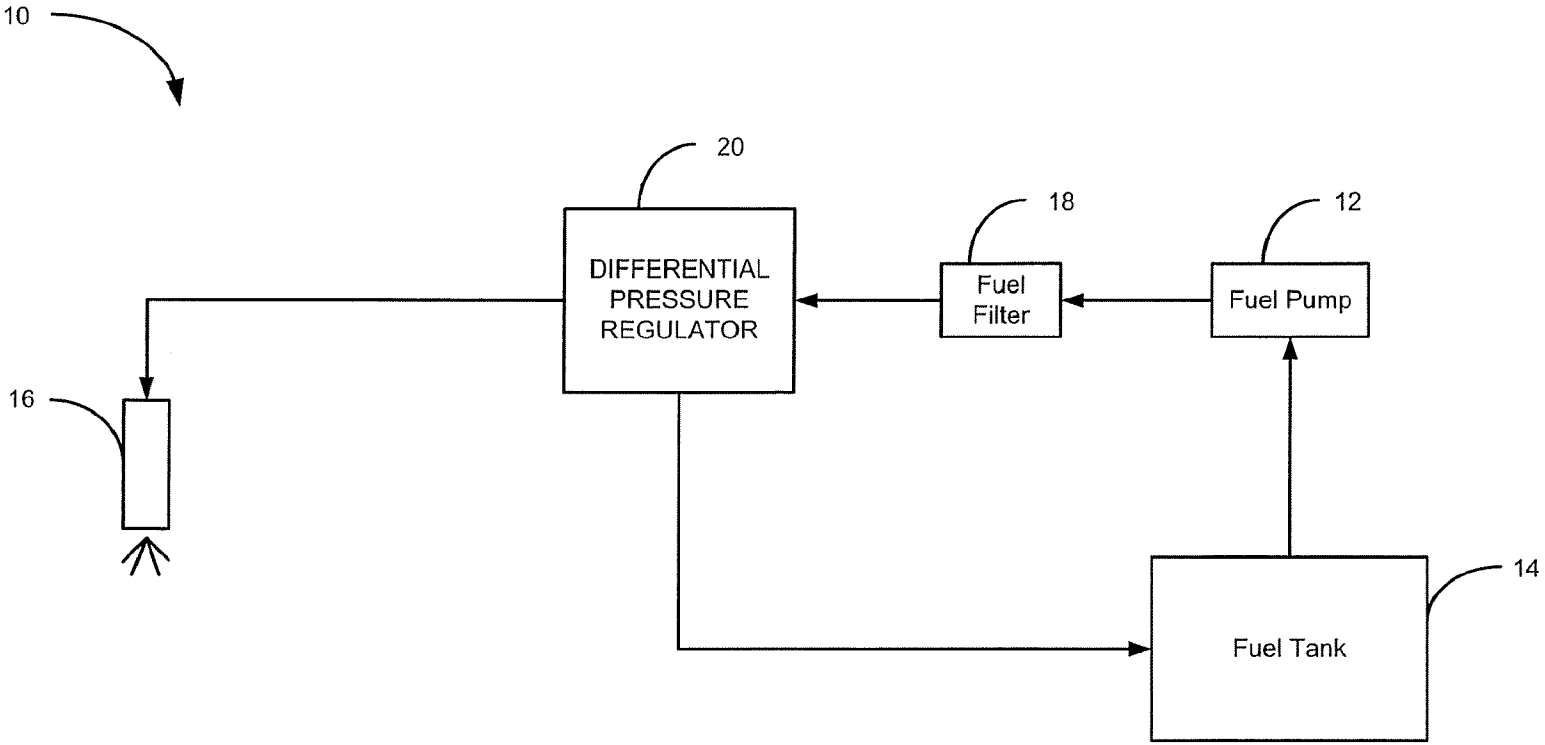
FIG. 1 is a functional block diagram of an automotive fuel system incorporating a differential pressure regulator according to the present invention.

The following description of the preferred embodiment(s) is merely exemplary in nature and is in no way intended to limit the invention, its application, or uses. For purposes of clarity, the same reference numbers will be used in the drawings to identify similar elements.

Referring to FIG. 1, an automotive fuel system 10 includes a fuel pump 12 that pumps fuel from a fuel tank 14 to a fuel injector 16. A fuel filter 18 is used to clean debris from the fuel before it is delivered to the fuel injector 16. The pressure of the fuel delivered to the fuel injector 16 is controlled to allow a desired quantity of fuel to pass through the fuel injector 16 into the cylinders of an engine. A differential pressure regulator 20 is incorporated in the fuel system 10 to provide the desired pressure control. Excess fuel is returned to the fuel tank 14 from the differential pressure regulator 20.

Figure 2:
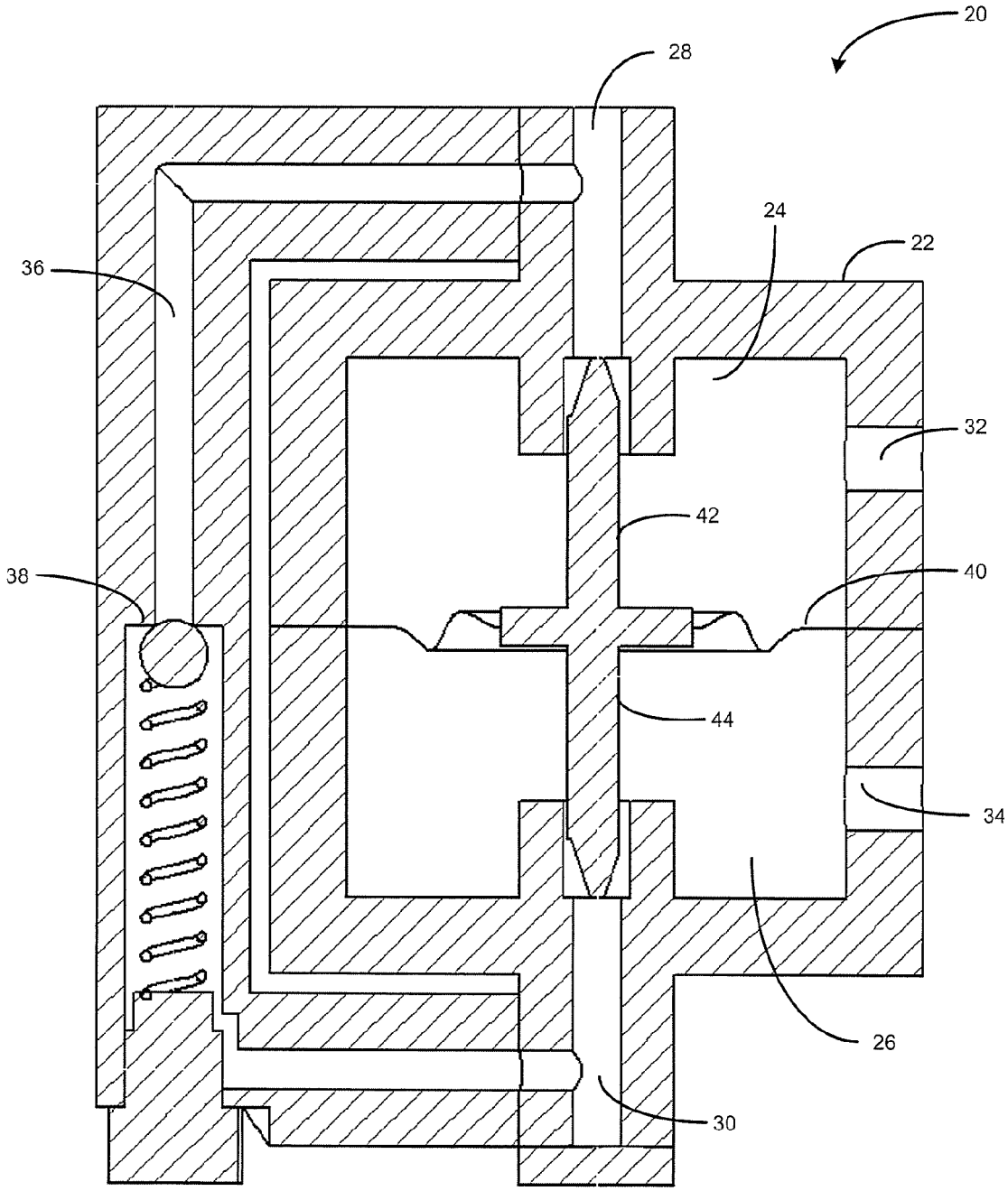
FIG. 2 is a schematic view of the differential pressure regulator according to the present invention.

Referring now to FIG. 2, the differential pressure regulator 20 includes a housing 22 that encases a first chamber 24 and a second chamber 26. The housing 22 includes a fuel pump inlet 28 that allows fuel to enter the first chamber 24 and a return orifice 30 that allows fuel to enter the second chamber 26. The housing also includes a first opening 32 in the first chamber 24 that allows fuel to flow into the fuel injector 16 and a second opening 34 that allows excess fuel to return to the fuel tank 14. A passage 36 which includes a spring loaded check valve 38 allows fuel to flow from the fuel pump inlet 28 to the return orifice 30. In applications where a variation of pressure is desired, the spring loaded check valve 38 may be replaced with a computer controlled valve.

A movable diaphragm 40 separates the first chamber 24 from the second chamber 26. The movable diaphragm includes a first needle valve 42, which is reciprocally disposed in the fuel pump inlet 28, and a second needle valve 44, which is reciprocally disposed in the return orifice 30.

Starting a vehicle activates the fuel pump 12 which creates high pressure inside the first chamber 24. The high pressure causes the diaphragm 40 to flex and moves the second needle valve 44 into a position completely blocking the return orifice 30. Once the pressure in the first chamber 24 reaches a desired threshold, typically 1-2% of maximum pressure from the fuel pump 12, the check valve 38 will open allowing fuel to flow through the passage 36 and into the second chamber 26. This will cause the diaphragm 40 to settle in an equilibrium state where the pressure in the first chamber 24 is equal to the pressure in the second chamber 36. Having pressure in both the first 24 and second chambers 26 of the differential pressure regulator 20 minimizes pressure fluctuations due to the inertia of the fuel.

When the fuel pump 12 is deactivated, high pressure less than the desired threshold remains in the first chamber 24 such that the check valve 38 is closed. Excess fuel in the second chamber 26 dissipates through the second opening 34 into the fuel tank 14 creating a low level atmospheric pressure in the second chamber 26.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and the following claims.

What is claimed is:

1. A differential pressure regulator comprising:

a housing having a first chamber and a second chamber;

a fuel pump inlet in fluid communication with a passage and said first chamber;

a return orifice in fluid communication with said passage and said second chamber;

a movable diaphragm that separates said first chamber from said second chamber;

a first needle valve connected to said diaphragm that is reciprocally disposed in said fuel pump inlet;

a second needle valve connected to said diaphragm that is reciprocally disposed in said return orifice;

a fuel injection supply opening in said first chamber; and a return opening in said second chamber.

2. The differential pressure regulator of claim 1 further comprising a check valve located inside said passage that prevents flow from said fuel pump inlet to said return orifice until a threshold pressure has been reached.

3. The differential pressure regulator of claim 2 wherein fuel is delivered to said fuel pump inlet creating high pressure in said first chamber.

4. The differential pressure regulator of claim 3 wherein said diaphragm is flexed and moves said second needle valve into a position that prevents flow from said return orifice into said second chamber.

5. The differential pressure regulator of claim 4 wherein pressure in said first chamber reaches said threshold pressure and said check valve allows flow from said fuel pump inlet to said return orifice through said passage.

6. The differential pressure regulator of claim 5 wherein said diaphragm settles in an equilibrium position having the pressure in said first chamber equal to the pressure in said second chamber.

7. The differential pressure regulator of claim 6 when fuel is no longer delivered to said fuel pump inlet, pressure less than said threshold pressure remains in said first chamber such that said check valve is closed.

8. A method of regulating pressure in a fuel system, comprising:

providing a housing with a first chamber and a second chamber;

providing a fuel pump inlet in fluid communication with a passage and said first chamber;

providing a return orifice in fluid communication with said passage and said second chamber;

providing a movable diaphragm that separates said first chamber from said second chamber;

providing a first needle valve connected to said diaphragm that is reciprocally disposed in said fuel pump inlet;

providing a second needle valve connected to said diaphragm that is reciprocally disposed in said return orifice;

providing a fuel injection supply opening in said first chamber; and providing a return opening in said second chamber.

9. The method of claim 8 further comprising, providing a check valve located inside said passage that prevents flow from said fuel pump inlet to said return orifice until a threshold pressure has been reached.

10. The method of claim 9 wherein fuel is delivered to said fuel pump inlet creating high pressure in said first chamber.

11. The method of claim 10 wherein said diaphragm is flexed and moves said second needle valve into a position that prevents flow from said return orifice into said second chamber.

12. The method of claim 11 wherein pressure in said first chamber reaches said threshold pressure and said check valve allows flow from said fuel pump inlet to said return orifice through said passage.

13. The method of claim 12 wherein said diaphragm settles in an equilibrium position having the pressure in said first chamber equal to the pressure in said second chamber.

14. The method of claim 13 when fuel is no longer delivered to said fuel pump inlet, pressure less than said threshold pressure remains in said first chamber such that said check valve is closed.

* * * * *